US005105945A

United States Patent [19]

Carver

[11] Patent Number: 5,105,945

[45] Date of Patent: Apr. 21, 1992

[54] DISPLAY CARRIER WITH RETAINING TABS

[75] Inventor: Robert G. Carver, Ashland, Ohio

[73] Assignee: Coburn, Inc., Ashland, Ohio

[21] Appl. No.: 622,556

[22] Filed: Dec. 5, 1990

[51] Int. Cl.[5] ..... B65D 85/44

[52] U.S. Cl. ..... 206/426; 206/45.14; 206/434; 229/40

[58] Field of Search ..... 206/426, 427, 429, 434, 206/45.14, 491; 229/40

[56] References Cited

U.S. PATENT DOCUMENTS

| | | | |
|---|---|---|---|
| 2,817,473 | 12/1957 | Foster | 229/40 |
| 3,854,580 | 12/1974 | Hennessey | 206/426 |
| 4,640,417 | 2/1987 | Durand | 206/426 |
| 4,735,314 | 4/1988 | Kadleck et al. | 206/426 |
| 4,798,291 | 1/1989 | Carver | 206/426 |
| 4,875,585 | 10/1989 | Kadleck et al. | 206/426 |
| 4,890,738 | 1/1990 | Carver | 206/434 |

FOREIGN PATENT DOCUMENTS

| | | | |
|---|---|---|---|
| 1565350 | 4/1980 | United Kingdom | 206/426 |

*Primary Examiner*—Bryon P. Gehman

*Attorney, Agent, or Firm*—Renner, Otto, Boisselle & Sklar

[57] ABSTRACT

A display carrier is described having improved retaining tabs. In one embodiment, the carrier includes snap acting retaining tabs connected to a partition wall at end edges thereof. For receiving glassware the snap acting retaining tabs are generally planar with the partition wall. To retain glassware once in place each snap acting retaining tab is rotated out of the plane of the partition wall to reversibly engage the glassware. In this position, outward movement of the glassware within the sleeve is restricted.

The carrier also includes a partition wall with opposed tab-receiving recesses. A slotted tab is associated with each recess via a hinged connection to the edge of a respective top or bottom wall. In its operative position, each slotted tab is at an angle to its wall and abuts an associated recess in a reversible locking engagement. Each recess includes a lip portion projecting outwardly from within the recess. Each lip portion extends through the slotted portion of a respective tab to secure the tab in place. With the tab thus inclined to the plane of its panel and secured by the recess, outward movement of the glassware within the sleeve is further restricted.

In another aspect of the invention, the display carrier is formed from a unitary, planar cardboard blank which is die cut and creased to form all the various panels and tabs of the carrier. The blank is folded and bonded to form a carrier sleeve which may be stored flat and subsequently erected to form a display carrier.

24 Claims, 7 Drawing Sheets

DISPLAY CARRIER WITH RETAINING TABS

FIELD OF THE INVENTION

The present invention relates to display carriers which are easy to assemble and fill with articles to be displayed such as glassware. More specifically, the invention relates to one-piece cardboard carriers or holders which are assembled in the form of a sleeve which encircles the articles and which has retaining tabs to prevent their movement laterally out of the holder.

BACKGROUND OF THE INVENTION

Glassware is commonly sold in cardboard containers which wrap around two, four or possible more glasses. Typically, the containers have a top, a pair of sides and a bottom joined together to form a sleeve surrounding the glasses. Glasses are put in the sleeve in a side-by-side arrangement. At least one partition wall extends vertically from the top to the bottom to separate the pairs of glasses and to keep the bottom from sagging. Tabs keep the adjacent glasses of each pair from touching. When glassware is ready for shipping, a worker assembles the cardboard container and puts the appropriate number of glasses in it.

Examples of such carriers are disclosed in U.S. Pat. No. 4,640,417 issued to Durand, U.S. Pat. No. 4,735,314 issued to Kadleck et al. and U.S. Pat. No. 4,875,585 issued to Kadleck et al. These carriers arrive at a glassware factory in a flattened state with retaining tabs extending outward from the top and bottom panels. In order to fill the container, a worker must erect it and insert the glassware. Once the glassware is in place, the worker folds retaining tabs at the top and bottom of the container to engage notches of the lower and upper end portions of a vertical partition wall to prevent the retaining tab in the notch from moving in either direction. The repetitive motions required of a worker who fills containers with glassware for an entire shift can produce fatigue.

Because of the competitive nature of the glassware industry, packaging technology has developed rapidly. The emphasis has continuously been on carriers which can be made from a single piece blank, can be flattened for storage, and can easily be erected to receive and present the glassware or other articles to be displayed. Thus, although prior art carriers are generally satisfactory for certain applications, there continues to be a need for an improved collapsible carrier which can be readily filled with articles with a minimum of manual manipulation, which offers ease of use, and which attractively displays articles in the carrier.

SUMMARY OF THE INVENTION

The present invention provides a display carrier having retaining tabs which are easy to use, offers superior article security and excellent article presentation. Specifically, the present invention provides a carrier sleeve having top and bottom walls, a pair of sidewalls, and at least one partition wall in the sleeve. In one embodiment, the carrier includes snap acting retaining tabs connected to the partition wall at end edges thereof. For receiving glassware the snap acting retaining tabs are generally planar with the partition wall. To retain the glassware once in place, each snap acting retaining tab is rotated out of the plane of the partition wall to reversibly engage the glassware. In this position, outward movement of the glassware within the sleeve is restricted.

The above carrier also includes a partition wall with opposed tab-receiving recesses. A slotted tab is associated with each recess via a hinged connection to the edge of a respective top or bottom wall. In its operative position, each slotted tab is at an angle to its wall and abuts an associated recess in a reversible locking engagement. Each recess includes a lip portion projecting outwardly from within the recess. Each lip portion extends through the slotted portion of a respective tab to secure the tab in place. With the tab thus inclined to the plane of its panel and secured by the recess, outward movement of the glassware within the sleeve is further restricted.

In another aspect of the invention, the display carrier is formed from a unitary, planar cardboard blank which is die cut and creased to form all the various panels and tabs of the carrier. The blank is folded and bonded to form a carrier sleeve which may be stored flat and subsequently erected to form a display carrier for displaying articles disposed in a row.

BRIEF DESCRIPTION OF THE DRAWINGS

FIGS. 8, 8*a*, 8*b* and 8*c* illustrate the positioning of a slotted retaining tab according to another embodiment of the present invention;

DESCRIPTION OF PREFERRED EMBODIMENTS OF THE INVENTION

Figure 1:
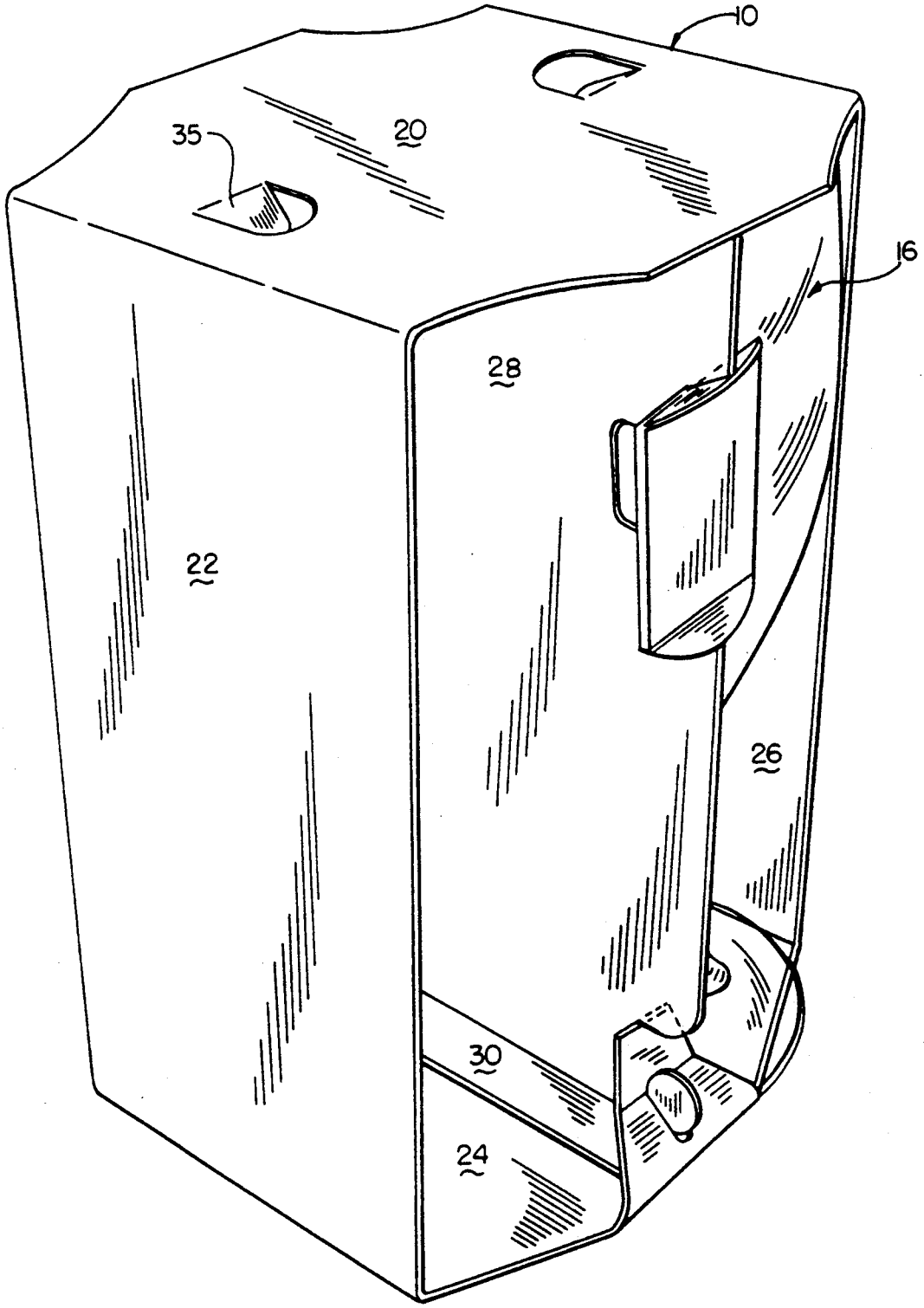
FIG. 1 is a perspective illustration of a carrier constructed in accordance with one embodiment of the present invention.

FIG. 1 shows one embodiment of a carrier sleeve of the present invention. The carrier 10 is formed from a cardboard blank 12 illustrated in FIG. 2 on a conventional folding machine. The blank 12 is essentially symmetrical about its longitudinal axis 14.

The blank 12 includes, in longitudinal succession, a top wall 20, a first sidewall 22, a bottom wall 24, and second sidewall 26, a partition wall 28, and a glue flap 30. Each wall (and the glue flap) is connected to its adjacent wall or walls by creased fold lines which are perpendicular to the longitudinal axis 14. In this embodiment, top wall 20 and bottom wall 24 contain arcuate cut out tabs 35 which help to separate articles and further serve as finger holes to facilitate lifting. The cut out tabs 35 may be replaced or supplemented by other conventional internal separators for the glassware such as those shown in U.S. Pat. Nos. 2,817,473, 4,640,417 and 4,875,585.

Retaining Tabs

The blank 12 also includes slotted retaining tabs 40 and "snap acting" retaining tabs 42 (two tabs on each opposed side) which extend from the bottom wall 24 and the partition wall 28 respectively. The slotted retaining tabs 40 serve to secure the bottom of an article, especially glassware, in the carrier sleeve while the snap acting retaining tabs 42 act to hold the middle or top of the glass in the carton. Depending on the configuration of the glassware, only one or the other of the retaining tabs 40 and 42 may be required.

1. Snap Acting Retaining Tabs

Figure 2:
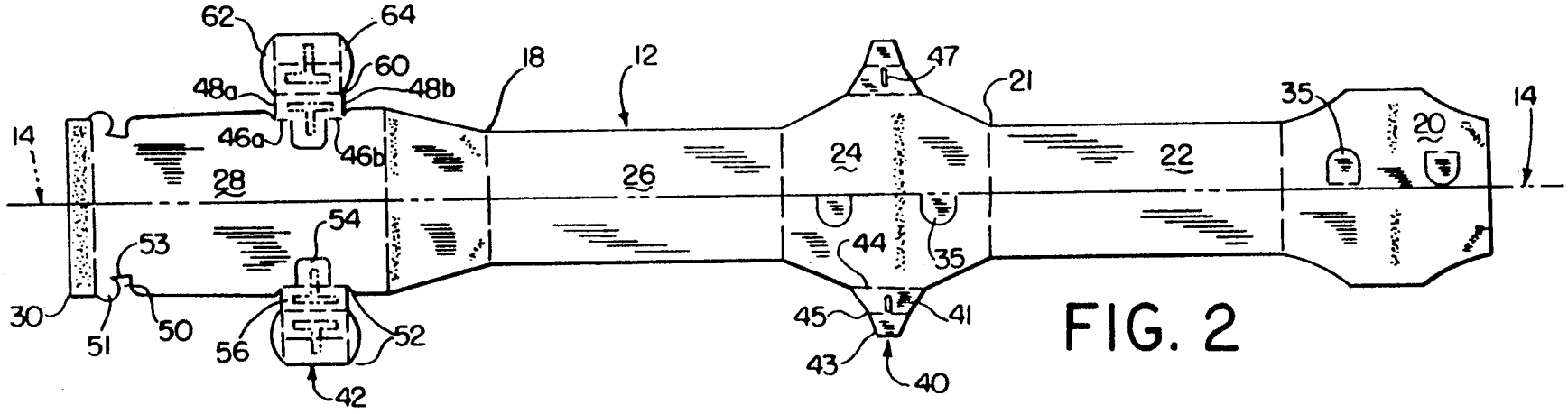
FIG. 2 is a plan view of a blank from which the carrier of FIG. 1 may be formed.

The term "snap acting" refers to the resilient swinging action of tabs 42 when they enter into reversible locking engagement with the partition wall 28 or the articles being displayed. Broadly, the snap acting retaining tabs (e.g. 42) are connected to the partition wall and are displaceable from a first position generally parallel to the partition wall for article insertion to a second position generally perpendicular to the partition wall for article retention. In the embodiment of FIGS. 1-2, as enlarged in FIG. 9, the retaining tabs 42 are connected to the partition wall 28 along two creases or "hinge" lines (fold lines) 46*a* and 46*b*. The hinge lines 46*a-b* are aligned or collinear with each other and are parallel to the longitudinal axis 14. It will be readily apparent that the hinge lines 46*a-b* have end points facing toward each other ("proximal ends") and end points facing away from each other ("distal ends"). In one embodiment, two notches 48*a-b* extend from the distal ends of hinge lines 46*a-b* at an angle thereto.

The snap acting retaining tabs 42 comprise a first panel 52 defined by an edge line extending around the panel to join the distal ends of hinge lines 46*a-b* and a second panel 54 that is defined by a cut line extending around the panel to join the proximal ends of hinge lines 46. Aligned hinge lines 46*a-b*, being the only means connecting panel 54 to the partition wall 28, afford an axis about which the second panel 54 can be swung in displacement from the partition wall 28. As seen in FIGS. 1 and 6*a-6c*, displacement of the second section 54 pivots it about the hinge lines 46*a-b*, such that the retaining tab 42 is transverse to partition wall 28 with a portion of the retaining tab 42 projecting to each side of the plane of the partition wall.

Figure 9:
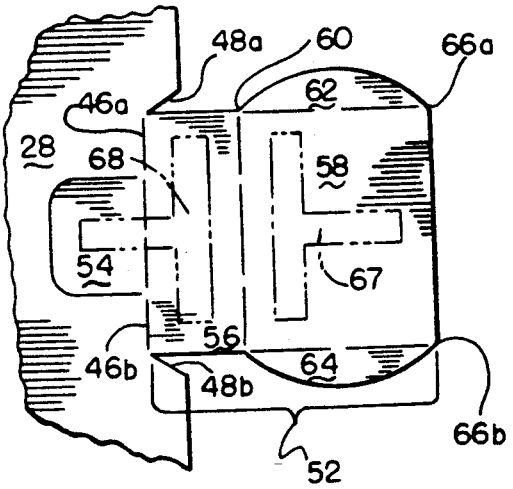
FIG. 9 is an enlarged view of the snap acting retaining tab in the blank of FIG. 2.
Figure 10:
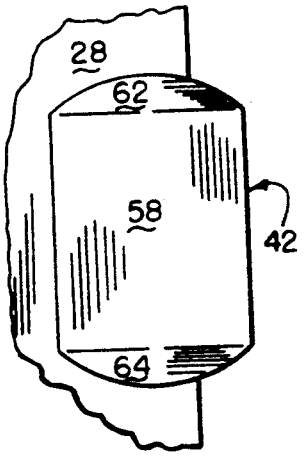
FIG. 10 is an enlarged view of a folded and bonded snap acting retaining tab of FIG. 9.

As illustrated in FIG. 9, snap acting retaining tab 42 has a first panel 52 containing first through fourth sections. The first section 56 is connected to the partition wall 28 along hinge lines 46*a-b*. The second section 58 is connected to the first section 56 along a medial fold line 60 that is parallel to the aligned hinge lines 46*a-b*. Opposed peripheral sections 62 and 64 are connected to the second section by opposed parallel fold lines 66*a-b*. In blank form snap acting retaining tab 42 contains matching adhesive sections 67 and 68. When the retaining tab 42 is assembled, section 58 is folded along fold line 60 over section 56 and panel 54 to yield the assembled snap acting retaining tab 42 as shown in FIG. 10.

Figure 6A:
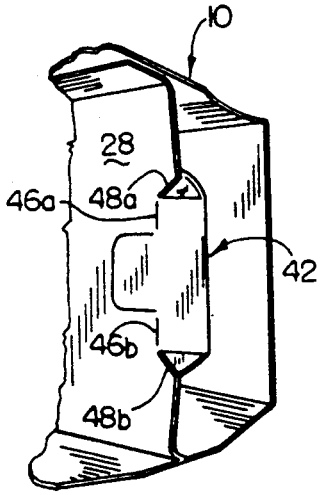
FIGS. 6*a*, 6*b*, 6*c* and 6*d* illustrate the positioning of a snap acting retaining tab according to one embodiment of the present invention.
Figure 6C:
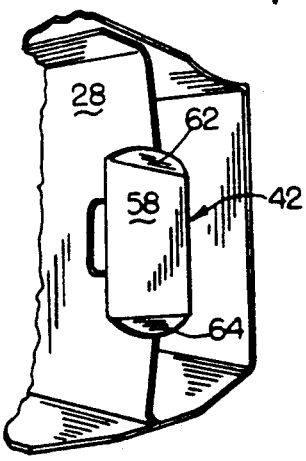

When in their operative position (shown in FIGS. 1 and 6*a-6c*), the retaining tabs 42 are effective to prevent accidental or unintentional removal of glassware from the carrier 10. As shown in FIG. 6*a*, snap acting retaining tab 42 rests generally planar with the partition wall 28 when the carrier sleeve 10 is in its article receiving state. In this state, a glass or other article may be moved laterally into a respective interior section of the sleeve on either side of partition wall 28.

Figure 6B:
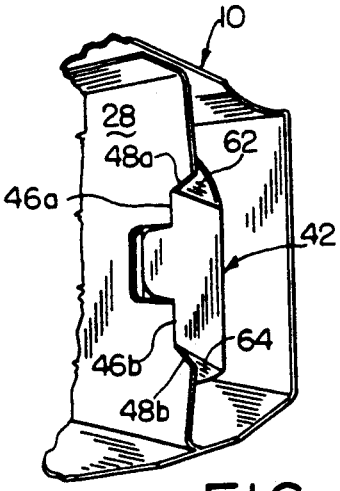

Once the articles have been placed within the sleeve, retaining tab 42 may be rotated out of the plane of partition wall 28 along hinge lines 46*a-b* (FIG. 6*b*). Rotation of the retaining tab 42 causes the peripheral sections 62 and 64 to engage notches 48*a-b* which extend from the distal ends of hinge lines 46*a-b* to the open end edge of partition wall 28. As rotation of the retaining tab 42 continues, the peripheral sections are folded by the notches 48*a-b* slightly out of the plane of the first and second sections 56 and 58 of the retaining tab.

Figure 6D:
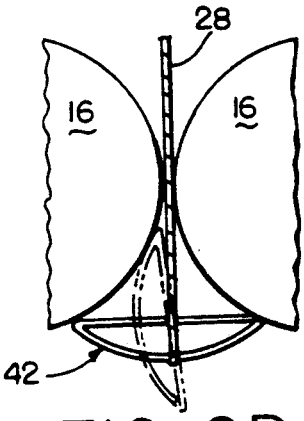

The length of the second section 58 from side to side as viewed in FIG. 9 is selected in accordance with the size of the article 16 to be held in the carrier 10. Specifically, the second section 58 is long enough so that it presses against or slides along the perimeter of the article 16 as it is turned into its active position resulting in a resilient "snap" like action. Moreover, the length of second section 58 is great enough that the panel 28 has to deflect or bend from being planar in order to allow the second section 58 to pass to its final position as illustrated by the dotted lines in FIG. 6*d*. Finally the length of second section is selected so that in its operative position the opposite vertical edges of the tab 42 touches the periphery of the article 16. This may be at a position like that shown in FIG. 6*d*, or it may be in a plane tangent to the two articles.

The crescent peripheral sections 62 and 64 serve to stabilize the tab 42 and make it rigid. As noted, when the tab 42 is turned from the 6*a* position to that shown in FIGS. 6*c* and 1, the peripheral sections 62 and 64 fold out of the plane of the second section 58. In the FIG. 6*c* position, the peripheral sections 62 and 64 keep the tab 42 from bending, and thus stiffening tab 42 and so helping to keep the articles 16 from falling or being forced out of the carrier 10. Thus, when each snap acting retaining tab 42 is in its operative position (FIGS. 1 and 6*c*), it remains in reversible locking engagement with said partition wall for the purpose of retaining articles within said carrier sleeve. Also, depending on the shape of the articles, the tab 42 may also be in reversible locking engagement with the articles.

Figure 11:
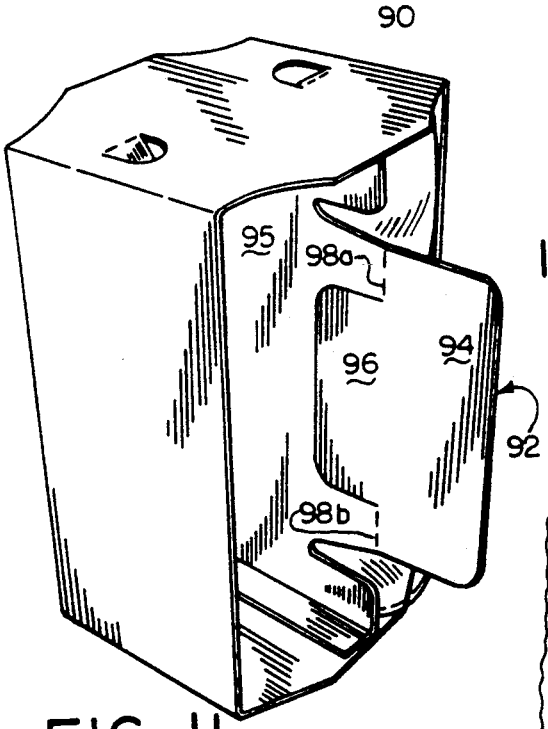
FIG. 11 is a perspective illustration of a carrier constructed in accordance with an alternate embodiment of the present invention.

FIG. 11 shows carrier 90 having another embodiment of a snap acting retaining tab 92. Retaining tab 92 includes first panel 94 defined by an edge line joining the distal ends of hinge lines 98*a* and 98*b* and a second panel 96 defined by a cut line joining the proximal ends of hinge lines 98*a-b*. Retaining tab 92 is adapted to swing out of the plane of partition wall 95 to a transverse position wherein first panel 94 projects toward one side of partition wall 95 and second panel 96 projects toward the other side of partition wall 95. The combined length of panels 94 and 96 is selected to allow tab 92 to "snap" against (press against or slide along) the perimeter of the particular article to be held in carrier 90 as it is turned into its transverse position.

FIGS. 12-13 and 14*a*-14*d* illustrate a snap acting retaining tab 70 according to another embodiment of the invention. The tab 70 is defined by a cut line 81 that joins the ends of internal fold line 69. Transverse fold lines in tab 70 define, in longitudinal succession, first side section 72, first front section 73, second front section 75, second side section 74 and glue flap 71. Angled fold lines in front sections 73 and 75 define peripheral sections 76*a*-76*d*. The tab 70 is folded along external fold line 77 and adhesively joined to partition wall 79 by glue flap 71.

Figure 13:
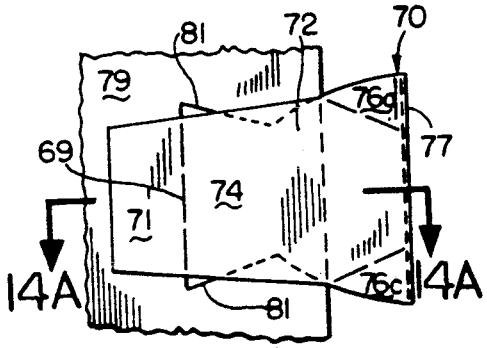
FIG. 13 is a side view of the retaining tab of FIG. 12 in an open position.
Figure 12:
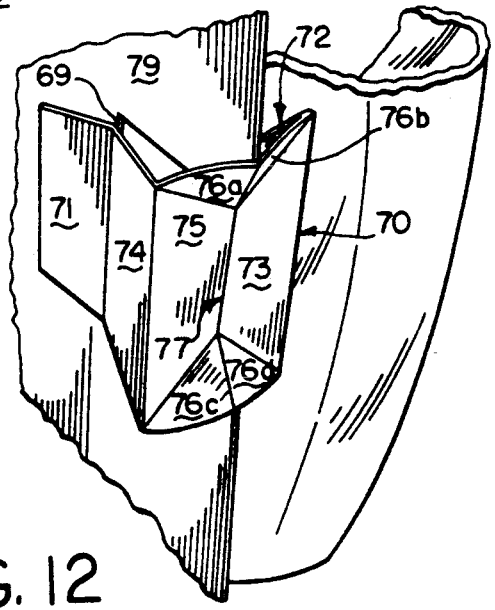
FIG. 12 is an enlarged view of a snap acting retaining tab in a closed position according to another embodiment of the present invention.
Figure 14A:
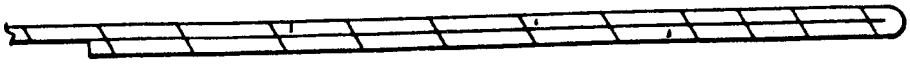
FIG. 14*a* is a cross-sectional view of the retaining tab of FIG. 13.
Figure 14B:
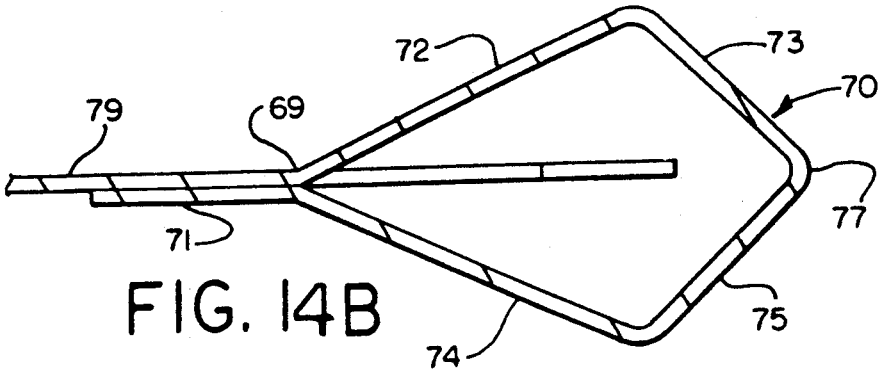
FIG. 14*b*–14*d* illustrate the positioning of the retaining tab of FIG. 12.
Figure 14C:
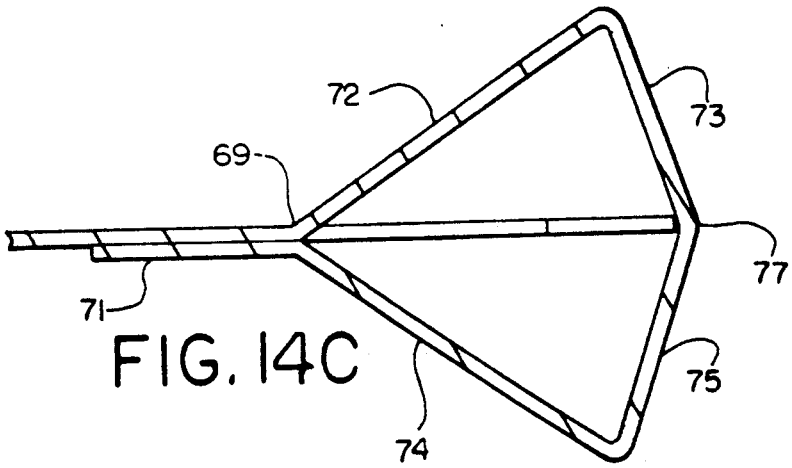
Figure 14D:
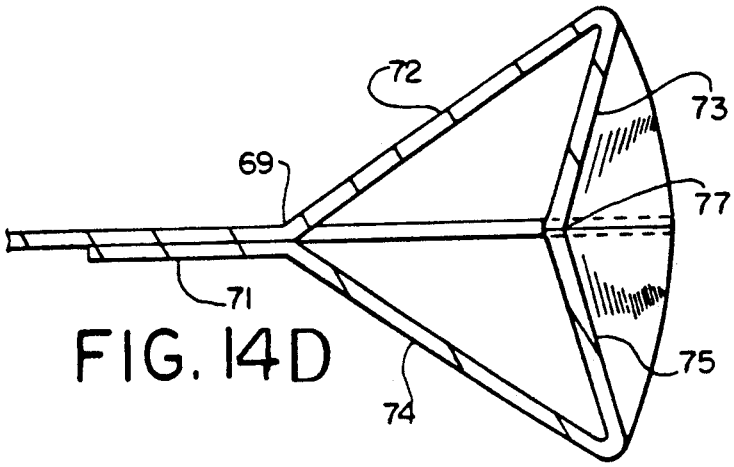

The retaining tab 70 rests in a generally planar configuration to the partition wall 79 when in its article receiving state (as illustrated in FIGS. 13 and 14). The combined length of the front and side sections (72, 73, 74 and 75) is selected in accordance with the size of a particular article to be held. Specifically, the combined length is long enough so that at least a portion of side sections 72 and 74 will press against or engage the articles being retained. As the tab 70 is displaced from its open position (FIGS. 13 and 14*a*) to its closed position (FIGS. 12 and 14*b*-*d*), the peripheral sections 76*a*-*d* and front sections 73 and 75 fold out of the plane of partition wall 79 as they engage the free end edge of partition wall 79. In the FIGS. 12 and 14*d* positions, the peripheral sections 76*a*-76*d* keep the tab 70 from bending, which helps keep articles from being forced out of the carrier. Thus, when snap acting retaining tab 70 is in its operative position (FIGS. 12 and 14*d*), it remains in reversible locking engagement with the partition wall 79 in a generally perpendicular configuration.

2. Slotted Retaining Tabs

The blank 12 (FIGS. 2 and 7*a*-*c*) also includes tab-receiving recesses 50, each having a projecting lip 51 and a straight edge region 53. Each tab-receiving recess 50 is associated with a slotted retaining tab 40. The slotted retaining tabs 40 are hinged along a first fold line 44 to bottom wall 24 of the carrier 10 and bridge the end edge of partition wall 28. Each retaining tab 40 includes a first section 41 and a second section 43. The second section 43 is connected to the first section 41 along a second fold line 45 that is parallel with the first fold line 44. In this embodiment, a slot 47 resides in the first section 41 of slotted retaining tab 40.

Figure 7A:
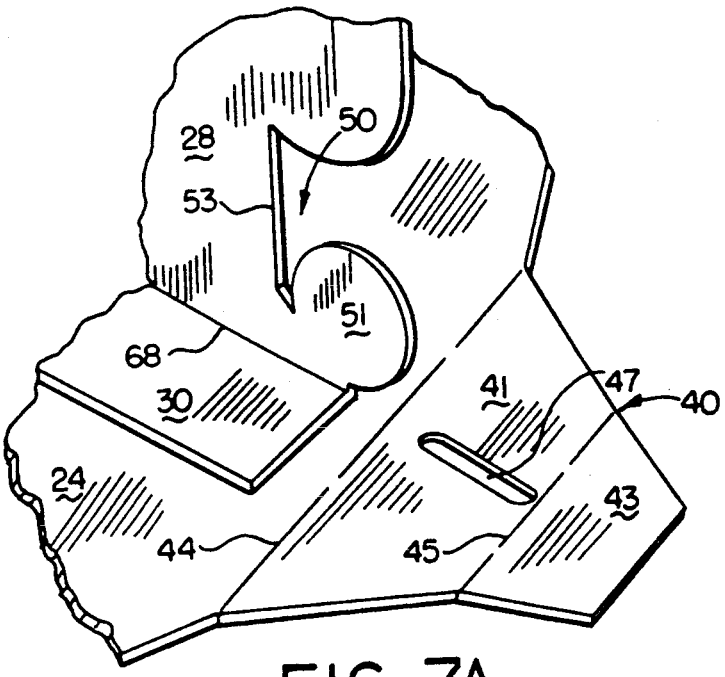
FIGS. 7*a*, 7*b* and 7*c* illustrate the positioning of a slotted retaining tab according to one embodiment of the present invention.
Figure 7B:
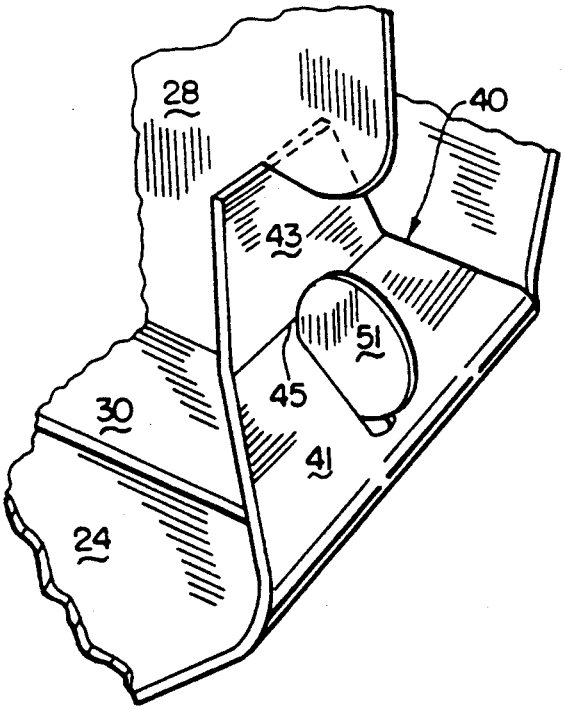
Figure 7C:
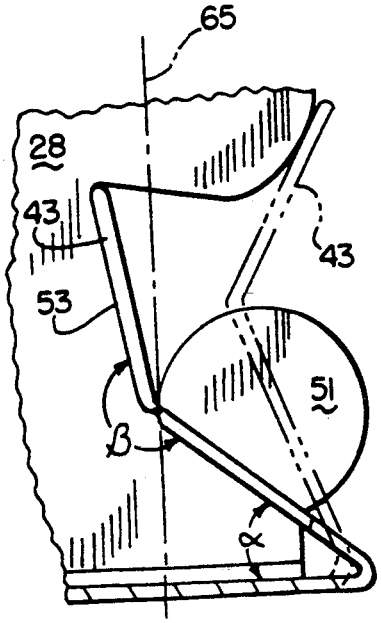

FIGS. 7*a*, 7*b* and 7*c* illustrate the relationship of a slotted retaining tab 40 and associated tab-receiving recess 50 according to one embodiment of the invention In this embodiment, the recess 50 includes lip 51 projecting upward from partition wall 28 proximate the hinged connection 68 of partition wall 28 and bottom wall 24. The hinged connection 68 is the fold line between glue flap 30 and partition wall 28. Straight edge region 53 extends from the inner edge of lip 51 at an acute angle $\alpha'$ to the perpendicular (shown at 65 in FIG. 7*c*) of the end edge of partition wall 28 (e.g., fold line 68). Slotted retaining tab 40 includes first section 41 and second section 43 connected along fold lines 44 and 45, respectively. The second section 43 corresponds in length to straight edge region 53 of recess 50. As seen in FIG. 1, the width of tab 40 is selected in accordance with the shape of the foot 19 of the article 16 to be held within the carrier 10. Specifically, the width of Section 41 along fold line 44 (FIG. 2) is such that a portion of the foot 19 of the article 16 abuts the inner side of tab 40. It will be appreciated from the foregoing that the carrier 10 of FIG. 1 is particularly suited for holding stemware such as wine glasses having a bowl, a stem and a foot.

The slotted retaining tab 40 engages the recess 50 by pivotal motion of first section 41 and second section 43 along fold lines 44 and 45 respectively. In this regard, the first section 41 swings inwardly to engage lip 51 at an acute angle $\alpha$ to the bottom wall 24 and the second section 43 swings outwardly to engage the straight edge region 53 at an oblique angle $\beta$ to the first section 41. Specifically, the opening of recess 50 between lip 51 and partition wall 28 is narrow enough that section 43 has to bend to a position nearly perpendicular to section 41 to allow the tab 40 to pass to its final position as illustrated by the dotted lines in FIG. 7*c*. Because the fold line 45 is only lightly creased, section 43 resiliently straightens against straight edge region 53 when section 41 is in place (FIG. 7*b*-7*c*). Since the full length of section 43 is the same as straight edge region 53, withdrawal of tab 40 is prevented unless section 43 is folded first. Thus, the second section 43 abuts the straight edge region 53 in a reversible locking engagement (FIGS. 7*b*-7*c*).

Figure 8A:
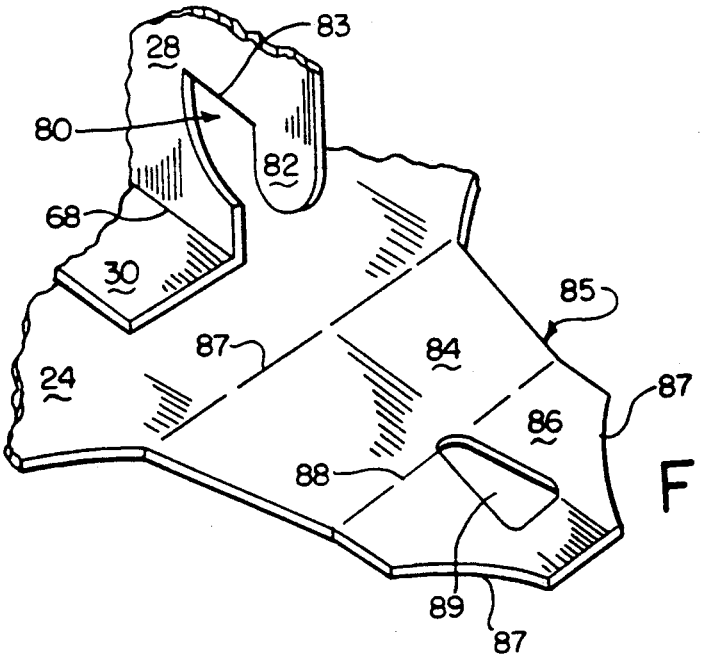
Figure 8B:
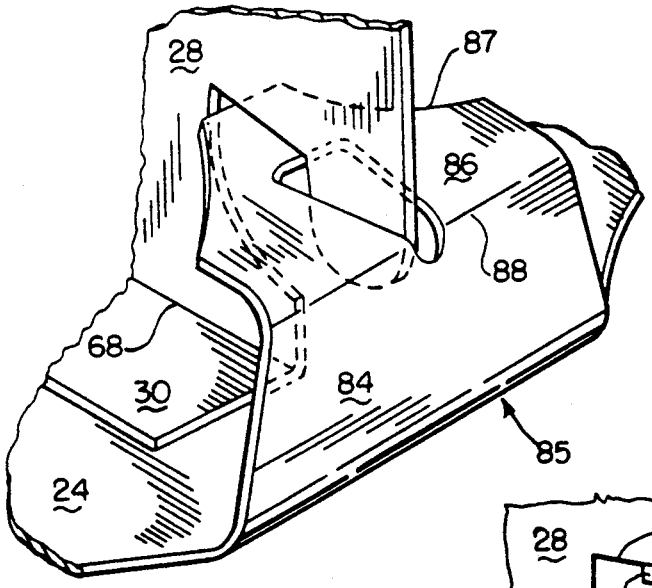
Figure 8C:
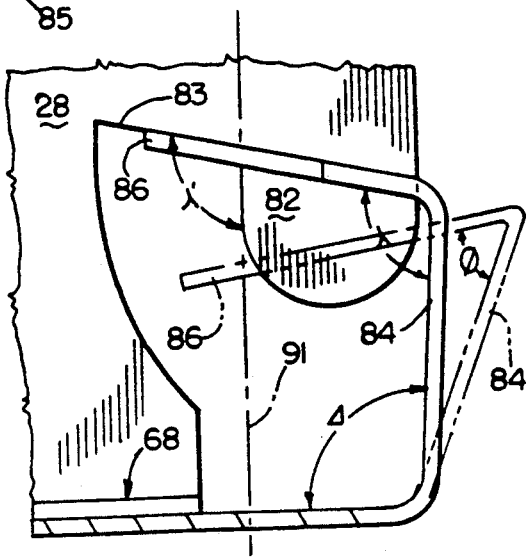

FIGS. 8*a*, 8*b* and 8*c* illustrate the relationship of a slotted retaining tab and associated tab receiving recess according to an alternate embodiment of the invention. In this embodiment, the recess 80 includes lip 82 projecting downward from partition wall 28 spaced from the hinged connection 68 of partition wall 28 and bottom wall 24. The hinged connection 68 is the fold line between glue flap 30 and partition wall 28. A straight edge region 83 extends from the inner edge of lip 82 at an oblique angle $\lambda'$ to the perpendicular (shown at 91 in FIG. 8*c*) of the end edge of partition wall 28 (e.g., fold line 68). Slotted retaining tab 85 includes first section 84 and second section 86 connected along the fold lines 87 and 88 respectively. The second section 86 contains slot 89. As will be readily appreciated, the retaining tab 85 is designed to secure generally cylindrical articles of glassware as opposed to wine glasses having a stem and a foot. In this regard, the free end edges 87 of section 86 are contoured to match the shape of articles to be retained in the carrier.

The slotted retaining tab 85 engages the recess 80 by pivotal motion of first section 84 and second section 86 along fold lines 87 and 88 respectively. In this regard, the first section 84 swings inwardly to abut lip 82 at an oblique angle $\Delta$ to the bottom wall 24 and the second section 86 also swings inwardly to engage the straight edge region 83 at an oblique angle $\lambda$ to the first section 84 such that lip 82 projects through slot 89. The opening of recess 80 between the inner edge of lip 82 and partition wall 28 is narrow enough that section 86 has to bend to a position at an acute angle $\phi$ to section 84 (dotted portion of FIG. 8*c*) to allow the lip 82 to pass through slot 89. Because the fold line 88 is only lightly creased, section 86 resiliently straightens against straight edge region 83 when section 84 is in place (FIGS. 8*a*-8*c*). Since lip 82 projects through slot 89, withdrawal of tab 85 is restricted unless section 86 is folded first. Thus, the second section 86 is reversibly hooked behind lip 82 in a reversible locking engagement (FIGS. 8*a*-8*c*).

It will be readily appreciated that the slotted retaining tabs can be associated with both top and bottom walls along with corresponding top and bottom recesses in the partition wall. Also, the slotted tabs may be contoured along their free end edges (see FIGS. 8*a*-8*c*) to match the contour of the glassware for which a particular carrier is intended. It is also apparent that both the slotted retaining tabs and snap acting retaining tabs can be combined separately or together in various ways depending upon the articles to be displayed and the presentation desired.

Construction of the Carrier

Figure 3:
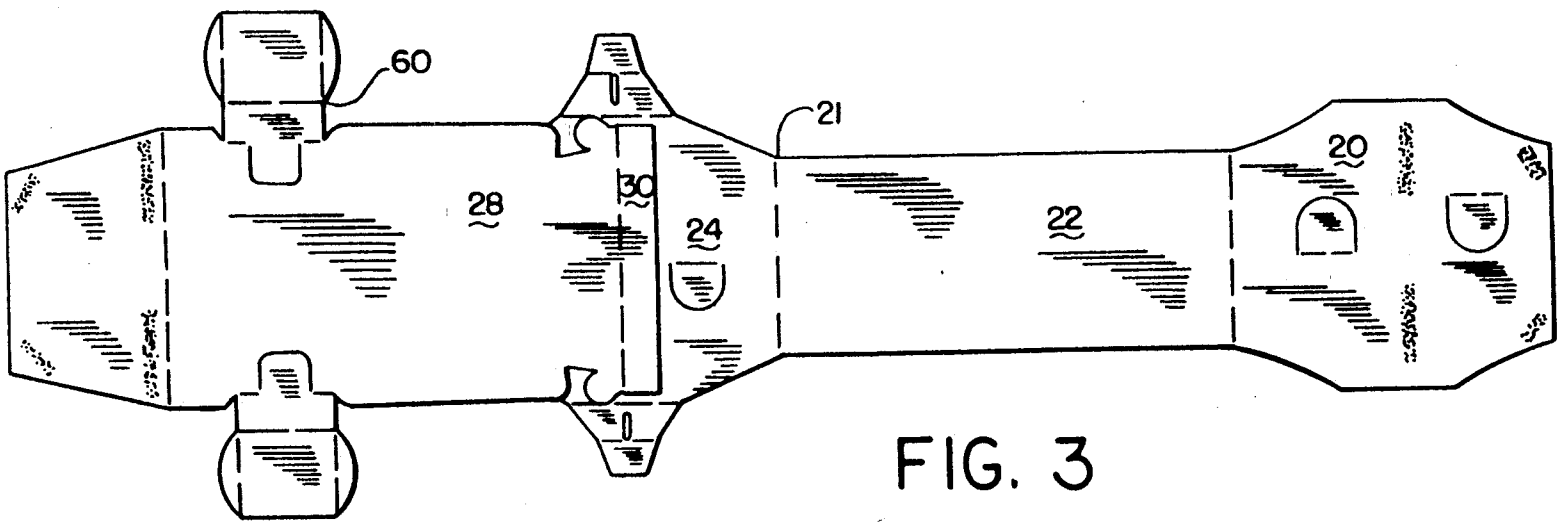
FIG. 3 is a plan view of a partially folded and bonded blank of FIG. 2.
Figure 4:
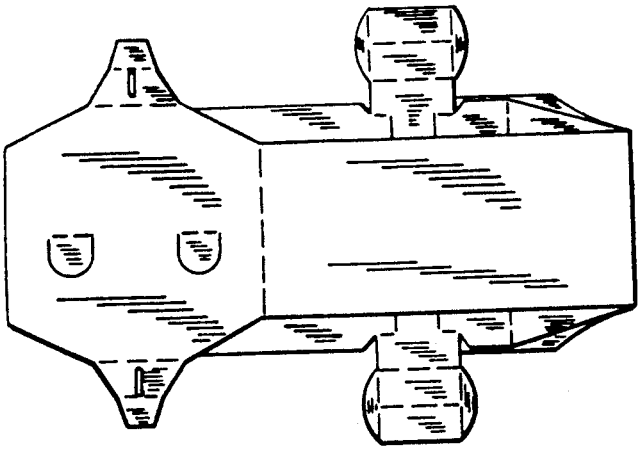
FIG. 4 is a bottom plan view of a fully folded and bonded blank of FIG. 2.
Figure 5:
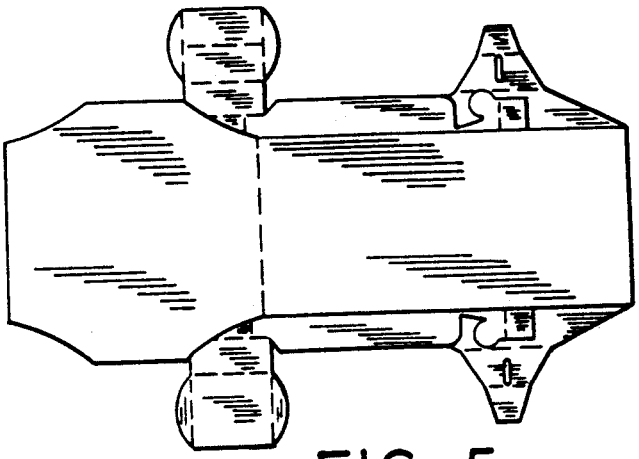
FIG. 5 is a top plan view of a fully folded and bonded blank of FIG. 2.

The carrier 10 is formed by first applying glue to the areas shaded in FIG. 2 and then by first folding the blank about transverse fold line 18 until the blank is partially folded as shown in FIG. 3. The blank is then folded about transverse fold line 21. Next, the slotted retaining tabs 42 are folded 180° about the fold lines 60 until sections 58, 62, and 64 of panel 52 lay flat against section 56 and panel 54. These steps produce the collapsed carrier 10 shown in the plan views of FIGS. 4 and 5.

The carrier 10 may then be erected to the configuration shown in FIG. 1 by grasping the carrier and pressing the fold lines 18 and 21 toward each other. The result is the carrier 10 shown in FIG. 1 which defines a sleeve with horizontal top and bottom walls, vertical side walls and a vertical partition wall. The vertical partition wall 28 divides the carrier 10 vertically in half.

The carrier 10 is proportioned to hold four wine glasses 16, two on each side of the partition wall 28. Arcuate tabs 35 are die cut into the top and bottom walls respectively. The tabs are coincident with longitudinal axis 14 and serve to prevent adjacent glasses on the same side of partition wall 28 from clinking against each other. The arcuate tabs in top wall 20 also serve as finger holes The invention has been described with reference to preferred embodiments. Obviously, modifications and alterations will occur to others upon reading and understanding of the specification. It is intended to include all such modifications insofar as they come within the scope of the appended claims or equivalence thereof.

What is claimed is:

1. A collapsible carrier for articles comprising:

horizontal top and bottom walls;

a pair of vertical side walls, each side wall being hingedly connected to each of said top and bottom walls to form a carrier sleeve having opposed open ends;

a partition wall extending between and hingedly connected to said top and bottom walls, said partition wall being parallel with said side walls and defining adjacent interior sections in said sleeve for receiving articles;

each of said walls having opposed end edges at the open ends of said carrier sleeve;

a retaining tab connected to the partition wall, the retaining tab being displaceable from a first position in which the retaining tab is generally parallel to the plane of the partition wall for insertion of articles into the carrier and a second position in which the retaining tab is generally perpendicular to the partition wall for retaining articles in the carrier.

2. The carrier of claim 1 wherein the retaining tab is pivotable from a first position in which the retaining tab is generally parallel to the plane of the partition wall for insertion of articles into the carrier and a second position in which the retaining tab is generally perpendicular to the partition wall for retaining articles in the carrier.

3. The carrier of claim 2 wherein said retaining tab is pivotable about an axis parallel with said partition wall.

4. The carrier of claim 3 wherein the stiffening means bears against surfaces of the partition wall as the retaining tab is rotated, thereby to move the stiffening panel out of the plane of the retaining tab.

5. The carrier of claim 2 wherein the retaining tab includes stiffening means for stiffening the retaining tab when the retaining tab is in the article retaining position, the stiffening means comprising a panel hinged along an edge of the retaining tab, the panel moving from a position in which it is coplanar with the retaining tab when the retaining tab is in the article receiving position to a position in which the plane of the panel is at an angle to the retaining tab when the retaining tab is in the article retaining position.

6. The carrier of claim 5 wherein the stiffening means is connected to the retaining tab along a fold line, said fold line extending perpendicular to the plane of the partition wall when the retaining tab is in the article retaining position.

7. The carrier of claim 2 wherein the retaining tab is proportioned to bear against an article in the sleeve, the retaining tab being proportioned so that the partition wall is distorted from a planar configuration when the retaining tab is at a position intermediate between its article receiving and article retaining positions, the vertical partition wall being in a generally planar condition at both the article receiving and article inserting positions.

8. A collapsible carrier for articles comprising:

horizontal top and bottom walls;

a pair of vertical side walls, each side wall being hingedly connected to each of said top and bottom walls to form a carrier sleeve having opposed open ends;

a vertical partition wall extending between and hingedly connected to said top and bottom walls, said partition wall being parallel with said side walls and thereby defining adjacent interior sections in said sleeve for receiving articles;

each of said walls having opposed end edges at the open ends of said carrier sleeve;

said carrier sleeve having an article receiving state for insertion of articles into the carrier and an article retaining state for retaining articles in the carrier;

a retaining tab hingedly connected to said partition wall at an end edge thereof by two aligned hinge lines, each of said hinge lines having proximal and distal ends, said retaining tab being generally planar with said partition wall when said sleeve is in its article receiving state, said retaining tab comprising:

a first panel defined by an edge line joining the distal ends of said hinge lines, said first panel projecting outward from the end edge of said partition wall when said sleeve is in its article receiving state;

a second panel defined by a cut line joining the proximal ends of said hinge lines, said second panel projecting inward from the end edge of said partition wall when said sleeve is in its article receiving state;

said retaining tab being generally transverse to said partition wall with a portion thereof projecting to each side of the plane of said partition wall when said sleeve is in its article retaining state.

9. The carrier of claim 8 wherein said first panel of said retaining tab includes a first section and a second section, said first section connected to said partition wall by said aligned hinge lines;

said second section connected to said first section along a medial fold line and terminating in a free end edge, said medial fold line being parallel to said aligned hinge lines;

wherein said second section is folded along said medial fold line across both the first section and the second panel of said retaining tab in adhesive engagement therewith such that at least a portion of said retaining tab is formed with at least two plies.

10. The carrier of claim 8 wherein the retaining tab comprises:

a first panel defined by an edge line joining the distal end of said aligned hinge lines, said first panel projecting outward from the end edge of said partition wall when said sleeve is in its article receiving state;

a second panel defined by a cut line joining the proximal ends of said aligned hinge lines, said second panel projecting inward from the end edge of said partition wall when said sleeve is in its article receiving state;

said a first section panel being formed of a first section, a second section a third section and a fourth section;

said first section connected to said partition wall along said aligned hinge lines;

said second section connected to said first section along a medial fold line and terminating in a free end edge, said medial fold line being parallel to said aligned hinge lines;

third and fourth peripheral sections connected to said second section along respective top and bottom peripheral fold lines and terminating in free end edges, said peripheral fold lines being perpendicular to said aligned hinge lines;

wherein said second section is folded along said medial fold line and adhered to one of the first section and the second panel of the retaining tab such that at least a portion of said retaining tab contains at least two plies;

said partition wall containing respective top and bottom notches in at least one end edge thereof, each of said notches extending outward from a juncture with a respective distal end of one of said aligned hinge lines at an acute angle thereto and each notch being adjacent to a respective peripheral section of said retaining tab when said carrier is in its article receiving state;

said retaining tab being generally transverse to said partition wall with a portion thereof projecting to each side of the plane of said partition wall when said sleeve is in its article retaining state such that said retaining tab is placed into releasable locking engagement with said partition wall when the third and fourth peripheral sections of said second panel engage said notches.

11. A collapsible carrier for articles comprising:

horizontal top and bottom walls;

a pair of vertical side walls, each side wall being hingedly connected to each of said top and bottom walls to form a carrier sleeve having opposed open ends;

a vertical partition wall extending between and hingedly connected to said top and bottom walls, said partition wall being parallel with said side walls and thereby defining adjacent interior sections in said sleeve for receiving articles;

each of said walls having opposed end edges at the open ends of said carrier sleeve;

a lip projecting from an end edge of said partition wall;

a slotted retaining tab hingedly connected to a top or bottom wall, the retaining tab being displaceable from a first position in which the retaining tab is generally parallel to the plane of the top or bottom wall for insertion of articles into the carrier and a second position in which the retaining tab is at an angle to the top or bottom wall wherein said lip extends into the slotted portion thereof for retaining articles in the carrier.

12. A collapsible carrier for articles comprising:

horizontal top and bottom walls;

a pair of vertical side walls, each side wall being hingedly connected to each of said top and bottom walls to form a carrier sleeve having opposed open ends;

a vertical partition wall extending between and hingedly connected to said top and bottom walls, said partition wall being parallel with said side walls and thereby defining adjacent interior sections in said sleeve for receiving articles;

each of said walls having opposed end edges at the open ends of said carrier sleeve;

said carrier sleeve having an article receiving state for insertion of articles into the carrier and an article retaining state for retaining articles in the carrier;

a slotted retaining tab hingedly connected along a first fold line to at least one of the top and bottom walls at an end edge thereof, said retaining tab comprising:

a first section connected along said first fold line to an associated top or bottom wall;

a second section connected to said first section along a parallel second fold line and terminating in a free end edge;

a tab-receiving recess associated with said slotted retaining tab located in the end edge of said partition wall proximate said retaining tab, said recess comprising:

a lip having inner and outer edges projecting from said partition wall and corresponding to the slotted portion of said retaining tab;

a straight edge region extending inward from a juncture with the inner edge of said lip at an angle to a line perpendicular to the top or bottom wall;

said tab-receiving recess thereby being configured for receiving its associated retaining tab so that, when the carrier is in its article-retaining state, said lip extends through the slotted portion of said retaining tab and at least a portion of said second section rests flush against said straight edge region at an angle to the plane of said first section.

13. The carrier of claim 12 wherein the retaining tab has first and second sections, said first section having a slot and said second section corresponding in length to said straight edge region;

said lip projecting from a position adjacent to the hinged connection between said partition wall and said top or bottom wall; and said straight edge region extending inward from a juncture with the inner edge of said lip at an acute angle to a line perpendicular to said top or bottom walls;

said retaining tab engaging said tab-receiving recess by pivotal motion of said first and second sections along said first and second fold lines whereby:

said first section swings inwardly to engage said lip at an acute angle to said top or bottom wall such that said lip extends through the slotted portion of said first section; and said second section swings outwardly to engage said straight edge region at an oblique angle to said first section;

wherein said second section abuts the straight edge region in a reversible locking engagement.

14. The carrier of claim 12 wherein a slot is formed in said second section of said retaining tab;

said lip in said tab-receiving recess projecting from a position spaced from the hinged connection between said partition wall and said top or bottom wall; and said straight edge region extending inward from a juncture with the inner edge of said lip;

said retaining tab engaging said tab-receiving recess by pivotal motion of said first and second sections along said first and second fold lines whereby:

said first section swings inwardly to abut the outer edge of said lip at an angle to said top or bottom wall; and said second section swings inwardly to engage said lip and said straight edge region at an angle to said first section such that said lip extends through the slot of said second section;

wherein said second section is reversible hooked behind said lip at the juncture of its inner edge and said straight edge region.

15. A collapsible carrier for articles comprising:

horizontal top and bottom walls;

a pair of vertical side walls, each side wall being hingedly connected to each of said top and bottom walls to form a carrier sleeve having opposed open ends;

a vertical partition wall extending between and hingedly connected to said top and bottom walls, said partition wall being parallel with said side walls and thereby defining adjacent interior sections in said sleeve for receiving articles;

each of said walls having opposed end edges at the open ends of said carrier sleeve;

said carrier sleeve having an article receiving state for insertion of articles into the carrier and an article retaining state for retaining articles in the carrier;

a first set of retaining tabs associated with said partition wall at opposed open ends of said sleeve, each of said retaining tabs being hingedly connected to said partition wall at a respective end edge thereof by two aligned hinge lines, each of said aligned hinge lines having proximal and distal ends, each retaining tab being generally planar with said partition wall, when said sleeve is in its article receiving state, each retaining tab comprising:

a first panel defined by an edge line joining the distal ends of said hinge lines, said first panel projecting outward from the end edge of said partition wall when said sleeve is in its article receiving state;

a second panel defined by a cut line joining the proximal ends of said hinge lines, said second panel projecting inward from the end edge of said partition wall when said sleeve is in its article receiving state;

each retaining tab being generally transverse to said partition wall with a portion thereof projecting to each side of the plane of said partition wall, when said sleeve is in its article retaining state, by swinging movement of said retaining tab along each of said hinge lines;

a second set of slotted retaining tabs associated with said partition wall at opposed open ends of said sleeve, each of said slotted retaining tabs being hingedly connected along a first fold line to a respective opposed end edge of a top or bottom wall, each slotted retaining tab comprising:

a first section connected along said first fold line to an associated top or bottom wall;

a second section connected to said first section along a parallel second fold line and terminating in a free end edge;

a set of tab-receiving recesses associated with said second pair of slotted retaining tabs located proximate a respective slotted retaining tab at opposed end edges of said partition wall, each tab-receiving recess comprising:

a lip having inner and outer edges projecting from said partition wall and corresponding to the slotted portion of an associated retaining tab;

a straight edge region extending inward from a juncture with the inner edge of said lip at an angle to a line perpendicular to the end edge of said partition wall;

each tab-receiving recess thereby being configured for receiving an associated slotted retaining tab so that, when the carrier is in its object-retaining state, said lip extends through the slotted portion of said retaining tab and at least a portion of said second section rests flush against said straight edge region at an angle to the plane of said first section.

16. A foldable blank for forming a collapsible carrier for articles comprising an elongated cardboard sheet having a plurality of parallel fold lines transverse to the longitudinal axis of said blank that define a plurality of distinct planar wall sections along the length of said sheet, each wall section having opposed end edges, one of said wall sections including:

a retaining tab hingedly connected to said one wall section at an end edge thereof by two aligned hinge lines that are parallel to the longitudinal axis of said blank, each of said hinge lines having proximal and distal ends, said retaining tab comprising:

a first panel defined by an edge line joining the distal ends of said hinge lines, said first panel projecting outward from an end edge of said wall section;

a second panel defined by a cut line joining the proximal ends of said hinge lines, said second panel projecting inward from an end edge of said wall section;

said retaining tab being rotatable out of the plane of said wall section about said aligned hinge lines into a rotated position wherein said first and second panels extend from said aligned hinge lines on opposite sides of said plane.

17. A foldable blank for forming a collapsible carrier for articles comprising an elongated cardboard sheet having a plurality of parallel fold lines transverse to the longitudinal axis of said blank that define a plurality of distinct planar wall sections along the length of said sheet, each wall section having opposed end edges, wherein a first wall section includes:

a slotted retaining tab hingedly connected along a first fold line to said wall section at an end edge thereof, said retaining tab comprising:

a first section connected along said first fold line to said wall section;

a second section connected to said first section along a parallel second fold line and terminating in a free end edge;

wherein a second wall section includes:

a tab-receiving recess located in an end edge of said second wall section, said recess comprising:

a lip having inner and outer edges projecting from said second wall section and corresponding to the slotted portion of said retaining tab; and a straight edge region extending inward from a juncture with the inner edge of said lip at an angle to the perpendicular of the end edge of said second wall section.

18. A foldable blank for forming a collapsible carrier for articles, said blank comprising a generally rectangular cardboard sheet having a plurality of parallel fold lines transverse to the longitudinal axis of said blank that define a plurality of distinct planar sections along the length of said sheet, each planar section having opposed end edges, said sections comprising, in longitudinal succession, a top wall, a first side wall, a bottom wall, a second side wall, a partition wall, and a glue flap;

said bottom wall including a slotted retaining tab, said slotted retaining tab being hingedly connected along a first fold line to an end edge of said bottom wall, said slotted retaining tab comprising:

a first section connected along said first fold line to said bottom wall;

a second section connected to said first section along a parallel second fold line and terminating in a free end edge;

said partition wall including:

a second retaining tab, said second retaining tab being hingedly connected to said partition wall at an opposed end edge thereof by two aligned hinge lines that are parallel to the longitudinal axis of said blank, each of said hinge lines having proximal and distal ends, said second retaining tab comprising:

a first panel defined by an edge line joining the distal ends of said hinge lines, said first panel projecting outward from a respective end edge of said partition wall;

a second panel defined by a cut line joining the proximal ends of said hinge lines, said second panel projecting inward from a respective end edge of said partition wall;

said second retaining tab being rotatable out of the plane of said partition wall about said aligned hinge lines into a rotated position wherein said first and second panels extend from said aligned hinge lines on opposite sides of said plane;

a tab-receiving recess located in an end edge of said partition wall adjacent said glue flap, said recess comprising:

a lip having inner and outer edges projecting from said partition wall and corresponding to the slotted portion of said slotted retaining tab;

a straight edge region extending inward from a juncture with the inner edge of said lip at an angle to the perpendicular of the end edge of said partition wall.

19. A collapsible carrier for articles comprising:

horizontal top and bottom walls;

a pair of vertical side walls, each side wall being hingedly connected to each of said top and bottom walls to form a carrier sleeve having opposed open ends;

a vertical partition wall extending between and hingedly connected to said top and bottom walls, said partition wall being parallel with said side walls and thereby defining adjacent interior sections in said sleeve for receiving articles;

each of said walls having opposed end edges at the open ends of said carrier sleeve;

said carrier sleeve being shiftable between an article receiving state for insertion of articles into the carrier and an article retaining state for retaining articles in the carrier;

a retaining tab hingedly connected to said partition wall by two hinge lines, each of said hinge lines having a proximal and a distal end, said retaining tab being generally coplanar with said partition wall when said sleeve is in its article receiving state, said retaining tab comprising:

a first panel defined by an edge line joining the distal ends of said hinge lines, and a second panel defined by an edge line joining the proximal ends of said hinge lines; said retaining tab being generally transverse to said partition wall with a portion thereof projecting to each side of the plane of said partition wall when said sleeve is in its article retaining state.

20. The carrier of claim 19 wherein said retaining tab is pivotable about an axis defined by said hinge lines.

21. The carrier of claim 20 wherein said retaining tab includes a third panel hingedly connected to one of said first and second panels along a fold line generally transverse to said axis, said third panel being foldable from a first position generally coplanar with said one of said first and second panels to a second position in which a plane defined by said third panel is transverse to a plane defined by said one of said first and second panels.

22. The carrier of claim 21 including means for folding said third panel from said first position to said second position as said carrier is shifted between the article receiving and article retaining states.

23. The carrier of claim 22 wherein said means for folding includes a surface of said vertical partition wall.

24. The carrier of claim 19 wherein said first panel includes a first section and a second section, said first section being connected to said partition wall by said hinge lines;

said second section being connected to said first section along a medial fold line and terminating in a free end edge, said medial fold line being generally parallel to an axis defined by said hinge lines;

wherein said second section is folded along said medial fold line and adhered to one of the first section and the second panel of said retaining tab such that at least a portion of said retaining tab contains at least two plies.

* * * * *